US006932510B2

(12) United States Patent
Sway et al.

(10) Patent No.: US 6,932,510 B2
(45) Date of Patent: Aug. 23, 2005

(54) GENERAL PURPOSE BAG HAVING FILM AND MESH PORTIONS

(75) Inventors: Jeffrey Sway, Los Angeles, CA (US); Harvey Friedman, Los Angeles, CA (US)

(73) Assignee: Mercury Plastics, Inc., City of Industry, CA (US)

( * ) Notice: Subject to any disclaimer, the term of this patent is extended or adjusted under 35 U.S.C. 154(b) by 95 days.

(21) Appl. No.: 10/192,079

(22) Filed: Jul. 10, 2002

(65) Prior Publication Data

US 2005/0147331 A1 Jul. 7, 2005

(51) Int. Cl.[7] ..... B65D 30/06
(52) U.S. Cl. ..... 383/117; 383/9; 383/102
(58) Field of Search ..... 383/117, 121, 122, 383/9, 100, 102

(56) References Cited

U.S. PATENT DOCUMENTS

| | | | | |
|---|---|---|---|---|
| 2,565,754 | A * | 8/1951 | Brady et al. | 383/102 |
| 3,123,279 | A * | 3/1964 | Day | 383/102 |
| 3,257,915 | A * | 6/1966 | Pierre et al. | 493/196 |
| 3,348,595 | A * | 10/1967 | Stevens, Jr. | 206/525 |
| 3,474,952 | A * | 10/1969 | Cover, Jr. et al. | 383/107 |
| 4,196,534 | A * | 4/1980 | Shibamoto | 40/665 |
| 4,207,983 | A * | 6/1980 | Wolske | 206/554 |
| 4,403,637 | A * | 9/1983 | Rivelles Sabater et al. | 383/9 |
| 4,801,081 | A * | 1/1989 | O'Connor | 232/1 C |
| 5,741,076 | A * | 4/1998 | Cammack | 383/9 |
| 6,185,908 | B1 * | 2/2001 | Madderom | 53/415 |
| 6,536,951 | B1 * | 3/2003 | Sill | 383/9 |

FOREIGN PATENT DOCUMENTS

| | | | | |
|---|---|---|---|---|
| DE | 002636821 | A * | 2/1978 | 383/117 |

* cited by examiner

*Primary Examiner*—Jes F. Pascua
(74) *Attorney, Agent, or Firm*—Kleinberg & Lerner, LLP; Marvin H. Kleinberg; Marshall A. Lerner

(57) ABSTRACT

A bag is made with a combination of mesh and film on both the front and back sides. For use with automatic filling machines, one side of the bag has a wicket strip with wicket holes to receive the wickets from the filling machines. If pneumatic or vacuum systems are used for bag opening, a fluid impervious assisting strip is bonded to the mesh wall at the bag mouth. A method of making such a bag includes the use of a continuous film web with adjacent continuous mesh webs. A linear seal joins the film web with the mesh webs after which the web is folded so that the free edges overlie each other. A transverse seal followed by a transverse cut results in a finished bag.

7 Claims, 5 Drawing Sheets

GENERAL PURPOSE BAG HAVING FILM AND MESH PORTIONS

BACKGROUND OF THE INVENTION

1. Field of the Invention

The present invention relates to bags in which objects of different sorts are carried and stored, and, more particularly, a bag having sides manufactured from a combination of mesh and film materials.

2. Description of the Related Art

In recent years, a combination film and mesh bag has been developed, primarily to provide greater strength to bags, which are machine filled. One wall of such bag was preferably a synthetic resin mesh while the other wall was a synthetic resin film, which may or may not have been made of the same material. Typical examples of such prior art may be found in the patents to Fox, U.S. Pat. Nos. 6,024,489; 6,030,120; and 6,190,044.

The prior art, such as the bags taught in the Fox patents preferred embodiments, consisted of a bag with a back wall of a mesh fabric and the front wall of a film, generally of the same synthetic resin material. An upper extension of film was provided with wicket holes so that the bag could be supported during automated filling operations.

The film wall was folded at the bottom and was bonded to the mesh wall, avoiding the necessity of a seam at the bottom of the bag. The film wall of the bag may have textual as well as decorative graphic material imprinted thereon.

The prior art bags are not without their shortcomings. For example, it has been determined that some commodities benefit from storage in bags which are cross-ventilated. The presence of a film wall can restrict cross-ventilation, thereby surrendering some of the benefits of the ventilation provided by the mesh wall.

The use of all mesh material for the bag can increase the ventilation. However, the mesh material that is used, is relatively expensive as compared to film. Thus, the use of substantial mesh portions increases the bag's overall cost. The use of all mesh is also undesirable because it cannot be easily used to print advertisements or other information on it. The ability to add advertising to the film portion of a bag increases the bag's overall acceptance in the commercial marketplace.

It is therefore an object of the present invention to provide a combination film and mesh bag that permits for adequate cross ventilation at an economical price. It is also an object of the present invention to provide a bag with sufficient film and mesh portions that will be acceptable to users.

SUMMARY OF THE INVENTION

According to a preferred embodiment of the present invention, a bag is fabricated with two walls, each partly mesh and partly film, both made from the same (or substantially the same) synthetic resin composition. The upper portion of each wall is mesh and the lower portion of each wall is a sheet of film that is folded with the free ends each being bonded to an end of the mesh sheets.

The sides of the mesh/film combination are bonded together, forming a bag with mesh upper portions and film lower portions with a continuous sheet forming the bottom of the bag. If the bag is to be used with automatic filling machines, a sheet of film is bonded to the top edge of one of the walls of the bag. This top sheet is provided with wicket holes. If pneumatic or vacuum assistance is utilized to open the bag, a further film strip can be bonded to the opposite mesh wall.

In a preferred embodiment, the film portion of the walls is in a "j-fold" configuration in which the mesh portion of the front wall is somewhat shorter than the mesh portion of the back wall, thereby providing a greater graphic display area on the front, predominantly film wall.

In alternative embodiments, the film portions of the front and back wall can be substantially equal, providing equal graphic areas on both walls and substantially equal strength to applied stresses. In yet another alternative embodiment, a bag is formed by sealing a combination of film and mesh sheets along three edges. However, the presence of a seam along the bottom of the bag could be considered a weakness and might limit such a bag to articles of relatively light weight.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DESCRIPTION OF THE PREFERRED EMBODIMENTS

A bag having film and mesh portions will be described. In the following description, various structural details, manufacturing methods and compounds will be described in order to give a more thorough understanding of the present invention. It will be apparent to those of skill in the art that the present invention may be practiced without these specific details. In other instances, well-known processes and structures are not specifically described so as not to obscure the present invention unnecessarily.

Figure 1:
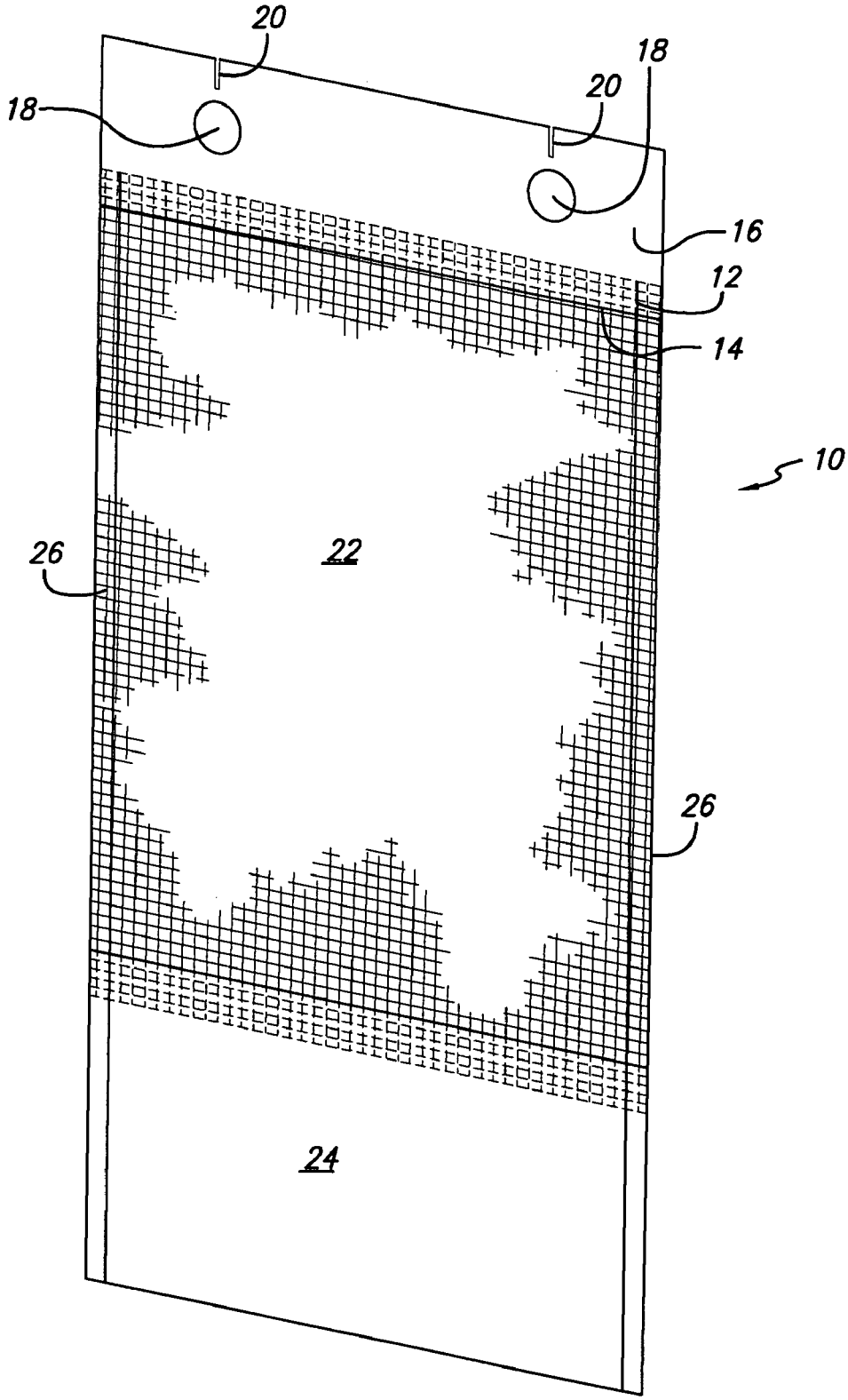
FIG. 1 is a front perspective view of a bag adapted for automatic filling machines.

Referring first to FIG. 1, a perspective view of the preferred embodiment of the bag 10 of the present invention is shown. Such a bag is useful for the storage of perishable commodities where cross ventilation is an asset. The front wall 41 and back wall 42 of the bag 10 are manufactured partially from synthetic plastic mesh and film materials. (These film materials are sometimes refered to as "webs"). The bag 10 has primarily a synthetic plastic mesh material 22 as the upper portion and a bottom portion 43 of a synthetic plastic film material 24.

Figure 2:
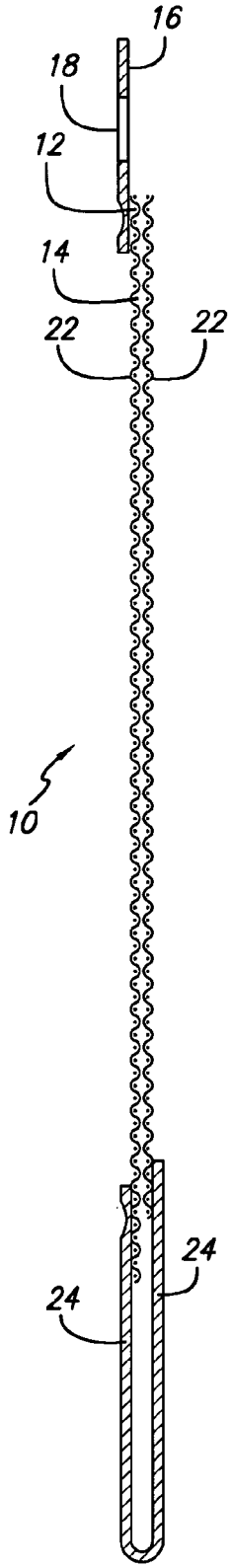
FIG. 2 is a side section view of the bag of FIG. 1.

In the preferred embodiments, the mesh and film are of the same (or substantially the same) material, a polyethylene plastic, which facilitates the bonding of the film material 24 to the mesh material 22. The front and back walls of the bag 10 are sealed together along the vertical edges 26. In the preferred embodiment, the bottom of the bag results from a folding of the film material 24, which constitutes the lower section of the bag 10. FIG. 2 illustrates a cross-sectional side view of the bag. As can be seen, the folded film results in a bottom portion of the front wall, and a bottom portion of the back wall.

In an embodiment of the bag 10 intended for use with automated filling machines, there is, bonded to the upper edge of one side 14 of the bag 10, a strip of film 16 with wicket holes 18 adapted fit upon wicket pins of commercially available bag-filling machines. A slit 20 is provided above each of the wicket holes 18 to facilitate easy removal of filled bags 10 from the machine.

It has been found that best results are achieved if the composition of the plastic material from which the mesh and film is created ranges from 20% to 40% prime polyethylene, 30% to 50% hexene polyethylene with slip, 0% to 6% colorant with the remainder being hexene polyethylene. The raw materials are available from several sources including Eastman, Dow and Chevron, to name a few.

Although the preferred embodiment utilizes mesh and film materials of the same chemical composition, it will be understood by those of skill in the art that exact identity of the composition of the two materials is not necessary. The film and mesh portions of the bag can be manufactured from materials having similar, although not identical composition. For example, the film and mesh materials may have chemical compositions that are within the ranges specified above, but of non-identical formulation.

Referring again to FIGS. 1 and 2, it is shown that the film and mesh portions in the preferred embodiment of the bag have differing vertical lengths. The vertical length is measured from the bottom of the film or mesh portion to its top edge. Generally, the front and back sides of the bag will have lengths which are approximately equal. The film portions on the front and back walls can also have different lengths from each other, as can the mesh portions.

FIGS. 1 and 2 illustrate the preferred embodiment of the bag. The mesh material 22 forms the upper portions of the front and back sides. The film material 24 forms the lower portions and the bottom. The bag is manufactured primarily of mesh, and film portion on the front of the bag has a greater vertical length than the film portion on the rear.

It will be apparent to those of skill in the art, however, that this arrangement of materials can be changed if desired without departing from the scope of the invention. For example, the bag can be manufactured with the mesh portion on the bottom, and the film on top. The ratio of the lengths of the film and mesh portions can also be varied. It is also not necessary that the front side of the bag be identical to the back side. In an alternative embodiment of the invention, the front side of the bag may have a small amount of mesh and a large amount of film, while the proportions of the two materials on the back side are reversed. The bag can also be constructed so that the film and mesh portions all have substantially equal lengths.

In producing such a bag 10, a continuous process includes the use of two rolls of mesh material, separated by a roll of film material. The edges of the film that is drawn from the film roll is bonded to the edges of the adjacent mesh fabric being drawn from the adjacent mesh rolls. After bonding, the continuous sheet is folded.

At predetermined intervals, a transverse seal is made. The seal could be wide or could be a double seal so that a transverse cut will result in two sealed edges. The resulting cut segments are then partially finished bags, to which wicket panels and assist strips could be added.

Figure 3:
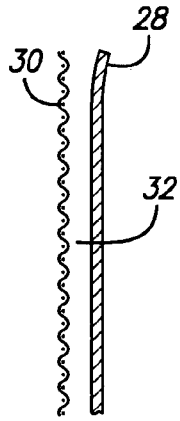
FIG. 3 is a side section view of an upper edge of a mesh bag wall with an adjacent film strip.
Figure 4:
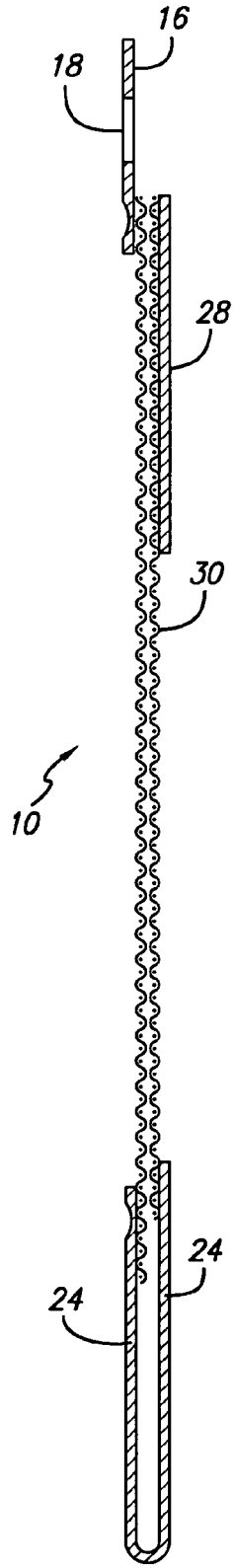
FIG. 4 is a side section view of an alternative embodiment of a bag of the present invention adapted for use with automatic filling machines using pneumatic or vacuum opening assistance.

FIGS. 3 and 4 illustrate the application of an assist strip 28 to a mesh side wall 42. In FIG. 3, a space 32 is shown, which exists prior to bonding. In FIG. 4, the assist strip 28 is shown bonded to the side wall 42 of the bag 10.

Figure 5:
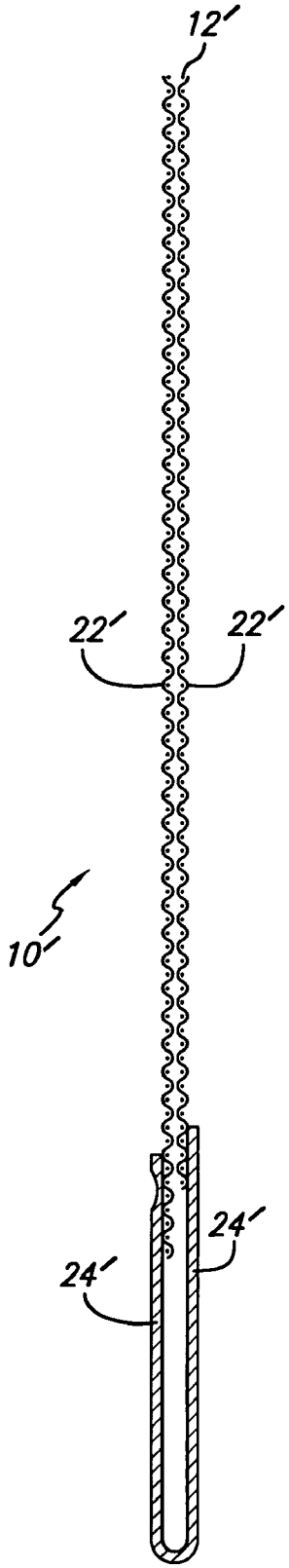
FIG. 5 is a side section view of an alternative embodiment of the bag of the present invention.

FIG. 5 is a side section view of an alternative embodiment of bag 10' of the present invention. The bag 10' is substantially identical to the bag 10 of FIG. 1 and, accordingly, similar reference numerals have been applied but with the addition of a prime ("").

The bag 10' is not intended for use with automated equipment and therefore lacks the wicket strip of bag 10 and the assist strip 28. The bag 10' includes the two mesh sides 41' and 42' and the film bottom portion 43'.

Figure 6:
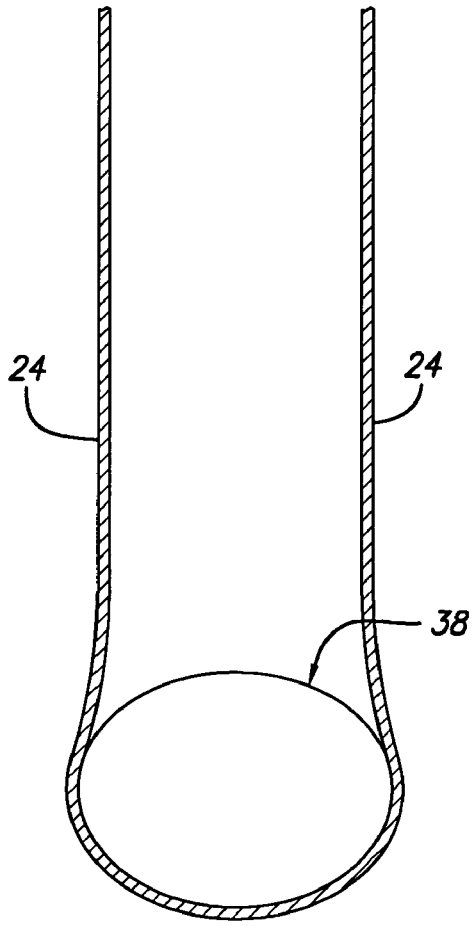
FIG. 6 is a side section view of the bottom portion of the bag of FIG. 1 with an item of produce.

Turning now to FIG. 6, there is shown the bottom film portion 43 of a bag 10 according to the present invention with an item or article of produce 38 resting therein. As can be seen in this embodiment, there is no bottom seam that will be stressed by the weight of the contents of the bag.

Figure 7:
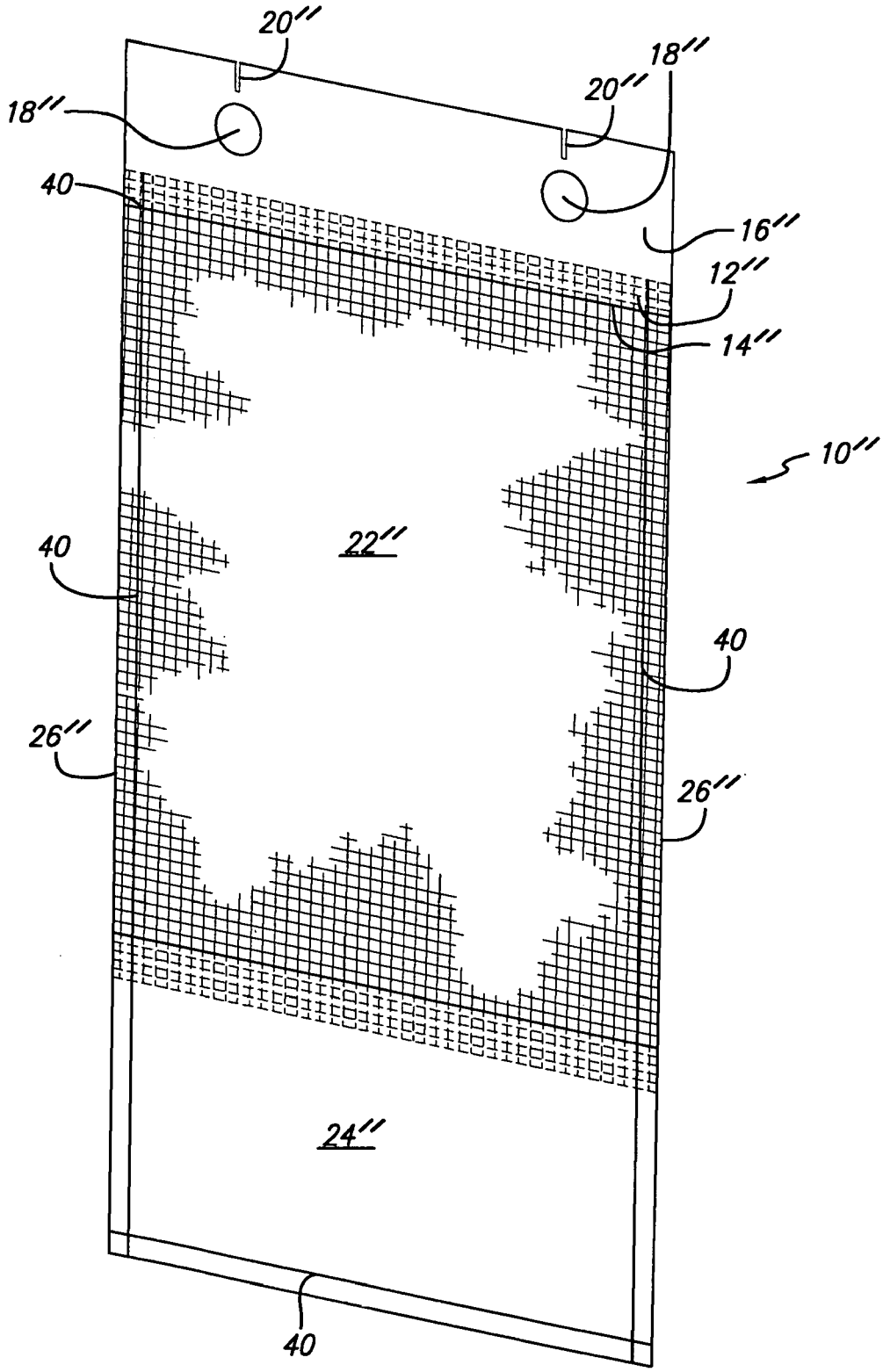
FIG. 7 is a front perspective view of yet another alternative embodiment of a bag according to the present invention with seals at the sides and the bottom of the bag.

FIG. 7 shows yet another alternative embodiment of the bag 10" of the present invention. The principal difference between the bag 10" of FIG. 7 and the other embodiments is that there is a seal or bond 40 on three sides of the bag, leaving an opening at the top of the bag. As shown, there is a seal 40 joining the mesh to the film in the front and back walls, a seal 40 bonding the front and back side walls together and a seal 40 bonding the film of the front and back walls at the bottom.

Other alternative embodiments of the bag of the present invention can utilize different synthetic resin film and mesh materials and may even use a combination of one resin for the film and another for the mesh. By way of example, the mesh and film may be manufactured from a polypropylene based plastic.

Figure 8:
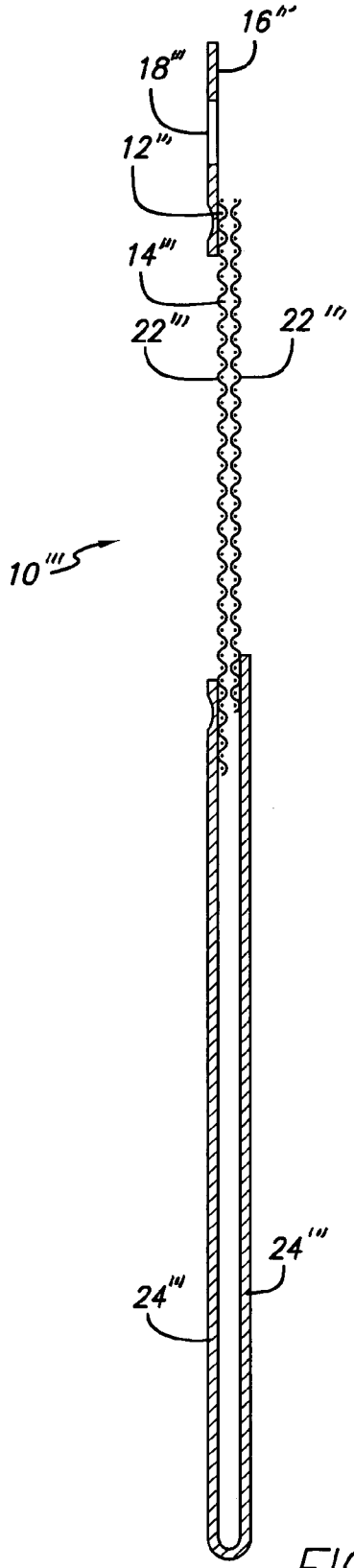
FIG. 8 is a side perspective view of the alternative embodiment of a bag according to the present invention depicted in FIG. 7.

Turning finally to FIG. 8, there is shown still another alternative embodiment of the bag 10'". The bag 10'" is in all respects similar to the bag 10' of FIG. 5 except that in this embodiment, the mesh portions 22'" are shorter than the film portions 24'". The other elements of the bag 10'" that are similar to corresponding elements of the bag 10' have been given similar reference numerals with a triple prime ('").

Yet other embodiments could combine fabric or paper materials with synthetic plastic materials to form a bag. Alternatively, the bag could be a combination of different materials. It is clear that such bags are not limited to produce but can be used to hold and transport virtually any product which could benefit from the combination of film and mesh in the front and back walls.

The feature common to the embodiments is the use of a mesh for at least part of the front and rear walls and the use of a sheet or film material for the remainder of the front and rear walls. While the preferred embodiments would have the sheet or film material as single sheet with opposite ends bonded to the front and back wall mesh sections, respectively, the bottom of the bag could be finished with a seam, bonding the composite back wall to the composite front wall.

The present invention is also not limited by the manner in which the front and back walls are bonded together. The preferred embodiment uses heat to bond the front and back walls together, as well as the film and mesh portions of each wall. In this embodiment the homogeneity of the film and mesh means that they will both melt at the same, or similar, temperature, thereby facilitating the bonding process.

It will be apparent to those of skill in the art that different means of bonding the elements of the bag together can be used. For example, the front and back walls could be held together by glue or stitching. The film and mesh portions could also be extruded as a single unit in the manufacturing process. Any suitable means of joining the parts of the bag together can be used with equal effectiveness.

Similarly, wicket tops and assistance strips can be provided to any bag made according to the present invention including bags of fabric and paper mesh film combinations. Accordingly, the invention should be limited only by the scope of the claims appended hereto.

What is claimed is:

1. A bag, comprising:

a first side, said first side including a first film portion and a first mesh portion, a second side, said second side including a second film portion and a second mesh portion, said second side being coupled to said first side along vertical edges thereof, said film and mesh portion being manufactured from a polyethylene-based resin wherein said polyethylene-based resin has the following composition: 20%–40% prime polyethylene, 30%–50% hexene polyethylene with slip, 0% to 6% colorant and the remainder being hexene polyethylene.

2. A bag, comprising:

a film panel folded in a substantially u-shape to form first and second lower film portions;

a first upper mesh portion coupled to a top edge of said first lower film portion so as to form a first side wall; and a second upper mesh portion coupled to a top edge of said second lower film portion so as to form a second side wall;

wherein said first and second side walls are bonded together along vertical edges thereof and wherein said film and mesh portions are manufactured from a polyethylene-based resin; said polyethylene-based resin having the following composition: 20%–40% prime polyethylene, 30%–50% hexene polyethylene with slip, 0% to 6% colorant and the remainder being hexene polyethylene.

3. A bag, comprising:

a film panel folded in a substantially u-shape to form first and second lower film portions, said first lower film portion having a length greater than said second lower film portion;

a first upper mesh portion bonded to a top edge of said first lower film portion so as to form a first side wall; and a second upper mesh portion bonded to a top edge of said second lower film portion so as to form a second side wall, said first and second side walls having substantially the same length, and being bonded together along vertical edges thereof;

wherein said film portions and said mesh portions are both manufactured from polyethylene-based plastic.

4. The bag of claim 3 further comprising a film strip having wicket holes attached to a top edge of said second side wall of said bag.

5. The bag of claim 3 further comprising a fluid impervious strip along an exterior of said first mesh portion, adjacent to a top edge of said first side wall of said bag.

6. A bag, comprising:

a film panel folded in a substantially u-shape to form first and second lower film portions, said first lower film portions having a length greater than said second lower film portion;

a first upper mesh portion bonded to a top edge of said first lower film portion so as to form a first side wall; and a second upper mesh portion bonded to a top edge of said second lower film portion so as to form a second side wall, said first and second side walls having substantially the same length, and being bonded together along vertical edges thereof;

wherein said film portions and said mesh portions are both manufactured from polyethylene-based plastics; and wherein said polyethylene-based plastic comprises 20%–40% prime polyethylene, 30%–50% hexene polyethylene with slip, 0% to 6% colorant and the remainder being hexene polyethylene.

7. A bag, comprising:

a film panel folded in a substantially u-shape to form first and second lower film portions, said first lower film portion having a length greater than said second lower film portion;

a first upper mesh portion bonded to a top edge of said first lower film portion so as to form a first side wall; and a second upper mesh portion bonded to a top edge of said second lower film portion so as to form a second side wall, said first and second side walls having substantially the same length and being bonded together along vertical edges thereof;

a strip attached to a top edge of said second side wall of said bag, said strip having wicket holes formed therein; and a fluid impervious strip along an exterior of said first mesh portion, adjacent to a top edge of said first side wall of said bag;

wherein said film portions and said mesh portions are both manufactured from polyethylene-based plastic comprising 20%–40% prime polyethylene, 30%–50% hexene polyethylene with slip, 0% to 6% colorant and the remainder being hexene polyethylene.

* * * * *